US011710907B1

(12) United States Patent
Wrigley

(10) Patent No.: US 11,710,907 B1
(45) Date of Patent: Jul. 25, 2023

(54) CLONE CAROUSEL WAVEGUIDE FEED NETWORK

(71) Applicant: LOCKHEED MARTIN CORPORATION, Bethesda, MD (US)

(72) Inventor: Jason Stewart Wrigley, Littleton, CO (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 542 days.

(21) Appl. No.: 16/738,955

(22) Filed: Jan. 9, 2020

(51) Int. Cl.

| | |
|---|---|
| ***H01Q 21/00*** | (2006.01) |
| ***H01P 11/00*** | (2006.01) |
| ***H01P 3/12*** | (2006.01) |
| ***H01P 1/207*** | (2006.01) |

(52) U.S. Cl.
CPC ..... *H01Q 21/0037* (2013.01); *H01P 1/207* (2013.01); *H01P 3/12* (2013.01); *H01P 11/002* (2013.01)

(58) Field of Classification Search
CPC ..... H01P 1/207; H01P 1/212; H01P 1/213; H01P 1/215; H01P 1/219; H01P 1/161; H01Q 21/0037; H01Q 21/24; H01P 3/12; H01P 3/123; H01Q 5/50; H01Q 5/55

See application file for complete search history.

(56) References Cited

U.S. PATENT DOCUMENTS

| | | | | |
|---|---|---|---|---|
| 7,408,427 | B1* | 8/2008 | Lee-Yow et al. | H01P 1/17 333/135 |
| 10,763,593 | B1* | 9/2020 | Wrigley | H01P 5/227 |
| 11,177,580 | B2* | 11/2021 | Wrigley et al. | H01Q 13/0258 |
| 11,228,116 | B1* | 1/2022 | Wrigley | H01Q 21/0037 |
| 2010/0149058 | A1* | 6/2010 | Bosshard et al. | H01P 1/161 343/756 |
| 2013/0342282 | A1* | 12/2013 | Uher | H01P 1/161 333/135 |
| 2016/0315382 | A1* | 10/2016 | Katase et al. | H01P 1/161 |
| 2018/0375214 | A1* | 12/2018 | Runyon et al. | H01Q 5/55 |

FOREIGN PATENT DOCUMENTS

| | | | | |
|---|---|---|---|---|
| WO | 2021083498 | A1* | 5/2021 | H01P 1/161 |

* cited by examiner

*Primary Examiner* — Seokjin Kim
(74) *Attorney, Agent, or Firm* — BakerHostetler

(57) ABSTRACT

A super-broadband waveguide feed network includes multiple receive (RX) full reject waveguide filters and multiple RX reject clone waveguide filters disposed in a clone carousel about an aperture port and configured to reject RX frequencies, and a branch line coupler configured to couple the multiple RX full reject waveguide filters and RX reject clone waveguide filters to other components of a waveguide feed network. The super-broadband waveguide feed includes an RX polarizer configured to couple to an end of the aperture port. The super-broadband waveguide feed is configured to be fabricated in one to three pieces composed of a single split plane on the zero-current region, and the super-broadband waveguide feed is circularly polarized.

17 Claims, 18 Drawing Sheets

900

| PARAMETER | UNITS | SPEC | SIMULATION | PREDICT |
|---|---|---|---|---|
| Tx Band | GHz | 20.2 - 21.2 | 20.2 - 21.2 | 20.2 - 21.2 |
| Rx Band | GHz | 43.5 - 45.5 | 43.5 - 45.5 | 43.5 - 45.5 |
| Tx Insertion Loss (Aluminum) | dB | < 0.5 | 0.41 | 0.45 |
| Rx Insertion Loss (Aluminum) | dB | < 0.2 | 0.09 | 0.12 |
| Tx Return Loss | dB | > 20 | 22 | 20 |
| Rx Return Loss | dB | > 20 | 43 | 35 |
| Tx Axial Ratio | dB | < 0.5 | 0.40 | 0.45 |
| Rx Axial Ratio | dB | < 0.25 | 0.10 | 0.15 |
| TE10 Isolation (in Rx Band)* | dB | > 65 | 121 | 70 |
| TE10 Isolation (in Tx Band) | dB | > 55 | 150 | 140 |
| TE20 Suppression (in Rx Band) | dB | > 65 | 80 | 70 |
| Rx HOM Suppression (minus TM11)** | dB | > 40 | 43 | 42 |
| Rx TM11 Suppression | dB | > 33 | 35 | 33 |
| Tx RHCP to LHCP Isolation | dB | > 23 | 26 | 24 |
| Rx RHCP to LHCP Isolation | dB | > 23 | 26 | 24 |

*Will be driven by TE20 mode

** HOM = Higher Order Modes, TM11 Mode will be optimized into a potter horn. We get ~33 dB on TM11

FIG. 9

CLONE CAROUSEL WAVEGUIDE FEED NETWORK

STATEMENT REGARDING FEDERALLY SPONSORED RESEARCH OR DEVELOPMENT

Not applicable.

FIELD OF THE INVENTION

The present invention generally relates to waveguide feed networks, and more particularly to a super-broadband circularly polarized waveguide feed network.

BACKGROUND

Typically, antenna waveguide feed networks which cover wide bandwidths are composed of many parts, have a high level of complexity and high mass. The numerous parts and high level of complexity can also lead to manufacturing risks and require extremely precise tuning, which can further increase the costs of manufacturing.

SUMMARY

According to various aspects of the subject technology, methods and configuration are disclosed for providing a low-cost and compact super-broadband dual-polarized multiband waveguide feed network.

In one or more aspects, a super-broadband waveguide feed network includes a TX junction having an aperture port, multiple RX reject full filters coupled to the aperture port and configured to reject RX frequencies, and multiple RX reject clone filters coupled to the aperture port and configured to reject RX frequencies. The super-broadband waveguide feed network also includes a branch line coupler coupled to the plurality of RX reject full filters and an RX polarizer coupled to the aperture port. The RX reject full filters and the RX reject clone filters are disposed symmetrically around the aperture port, and the super-broadband waveguide feed network is circularly polarized.

In one or more aspects, an antenna array system includes an antenna array consisting of multiple antenna elements and multiple super-broadband waveguide feed networks, each coupled to an antenna element of the antenna array. Each super-broadband waveguide feed network includes a TX junction having an aperture port, multiple RX reject full filters coupled to the aperture port and configured to reject RX frequencies, and multiple RX reject clone filters coupled to the aperture port and configured to reject RX frequencies. Each super-broadband waveguide feed network also includes a branch line coupler coupled to the RX reject full filters and an RX polarizer coupled to the aperture port. The RX reject full filters and the RX reject clone filters are disposed symmetrically around the aperture port and the super-broadband waveguide feed network is circularly polarized.

In one or more aspects, a method of manufacturing a super-broadband waveguide feed network includes fabricating a first piece comprising an air cavity including an aperture port, RX reject clone filters for coupling to the aperture port, RX reject full filters for coupling to the aperture port, and a coupler for coupling to the RX reject full filters, the coupler having RHCP and LHCP ports. The method also includes fabricating a second piece comprising an RX polarizer hving RHCP and LHCP ports. The method further includes fabricating a third piece comprising air cavities for enclosing the first piece, for receiving the second piece, and for receiving waveguide network components. The super-broadband waveguide feed network is configured to suppress the launch of higher order modes TE01, TM01, TM11, TE21 and TE31.

The foregoing has outlined rather broadly the features of the present disclosure so that the following detailed description can be better understood. Additional features and advantages of the disclosure, which form the subject of the claims, will be described hereinafter.

BRIEF DESCRIPTION OF THE DRAWINGS

For a more complete understanding of the present disclosure, and the advantages thereof, reference is now made to the following descriptions to be taken in conjunction with the accompanying drawings describing specific aspects of the disclosure, wherein:

FIG. 9 is a table illustrating a performance summary of an example clone carousel feed network, according to certain aspects of the disclosure.

DETAILED DESCRIPTION

Figure 1:
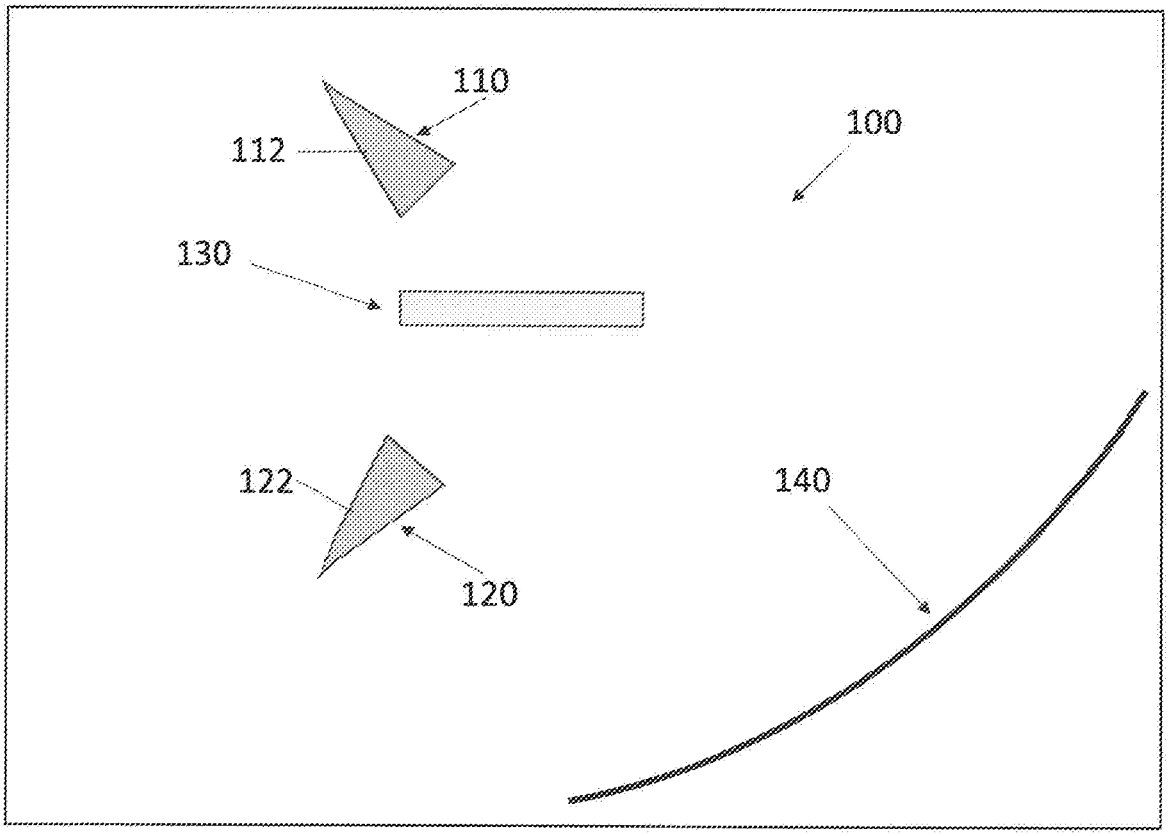
FIG. 1 is a schematic diagram illustrating an example of a typical TX and RX waveguide feed.

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and can be practiced using one or more implementations. In one or more instances, well-known structures and components are shown in block-diagram form in order to avoid obscuring the concepts of the subject technology.

Methods and configurations are described for providing a low-cost and compact super-broadband circular polarization waveguide feed network. The subject technology provides for a high performance, low mass and low-cost waveguide feed network solution for extended multi-bands, including a 20/45 band (e.g., TX: 20 GHz and RX: 45 GHz). The waveguide feed can be readily scaled to other frequency bands than the 20/45 band. The subject technology provides for a single dual band feed solution with a TX junction in circular waveguide with multiple RX reject clone filters and RX reject full filters spaced symmetrically about the aperture port. It is this positioning and selection that leads to significant mass and complexity reductions as well as manufacturing risk mitigation.

In particular, the subject technology relates to super-broadband circular polarization waveguide feed networks with dual polarization transmit (TX) in a transmit band (e.g., 20 GHz) and dual polarization receive (RX) in a receive band (e.g., 45 GHz) of the electromagnetic spectrum. In one or more implementations, the super-broadband circularly polarized waveguide feed of the subject technology can be a waveguide with multiple RX reject full filters and multiple RX reject clone filters where the waveguide is composed of a single split plane on the zero-current region. In one or more implementations, the feed can be desirably fit under the smallest aperture sizes for array configurations.

In one or more implementations, by utilizing RX reject clone filters in addition to RX reject full filters, the subject technology allows for the entire waveguide feed to be split on the zero-current region, and maintain symmetry and mitigate manufacturing risk. In one or more implementations, the use of RX reject clone filters in a clone carousel allows for suppression of all higher order modes without degrading axial ratio of the waveguide feed. In one or more implementations, positioning of the entire waveguide feed on one split plane allows for significant miniaturization, mass reduction, and manufacturing risk reduction. In one or more implementations, by utilizing RX reject clone filters in a clone carousel, the waveguide feed does not require perfection or tuning because there are no recombination paths.

Existing solutions are typically at a much higher level of complexity (e.g., multipart multi-component assembly) and costs. The disclosed waveguide feed can be made of three pieces and/or sections at a fraction of the cost of the traditional approach.

For the purposes of the present disclosure TX is the lower operating band and RX is the higher operating band. However, the TX and RX nomenclature here could be reversed as would be typical of a ground antenna rather than a space antenna.

FIG. 1 illustrates a typical single band TX and single band RX waveguide feed network 100. The waveguide feed network 100 includes a transmit feed 110 with its own transmit horn 112, a receive feed 120 with its own receive horn 122, a dichroic sub reflector 130 and a reflector 140. The transmit feed 110 operates within 20.2 to 21.2 GHz and the receive feed 120 operates within 43.5 to 45.5 GHz. The dichroic reflector 130 looks transparent to TX signals and reflective to RX signals. The waveguide feed network 100 has long waveguide runs to each of the transmit feed 110 and the receive feed 120, which results in increased insertion loss.

Figure 2:
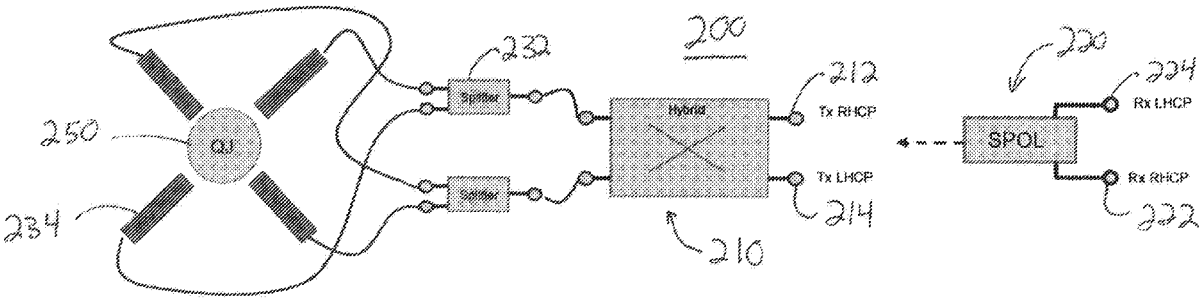
FIG. 2 is a schematic diagram illustrating an example of a typical dual band waveguide feed network.

FIG. 2 is a schematic diagram illustrating a typical dual band TX and RX waveguide feed network 200. The waveguide feed network 200 includes a transmit feed section 210, a receive feed section 220 and a filter section 230. The transmit feed section 210 has a right hand circularly polarized (RHCP) signal port 212 and a left hand circularly polarized (LHCP) signal port 214. Similarly, the receive feed section 220 has a RHCP signal port 222 and a LHCP signal port 224. The transmit feed section 210 is coupled to the filter section 230 via two splitters 232. Each splitter 232 is coupled to two RX reject filters 234 and the RX reject filters 234 are coupled to a quadrature junction coupler 250.

Figure 3:
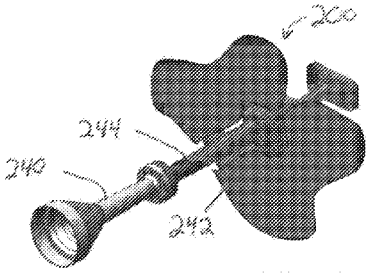
FIG. 3 is a perspective view of the dual band waveguide feed network schematically illustrated in FIG. 2.

As shown in FIG. 3, the waveguide feed network 200 has a core waveguide (e.g., horn) 240. The waveguide feed network 200 is a multipart electroform with a high level of complexity. Also, the TE31 mode is not suppressed by the filter section 230, so a square waveguide 242 is required to suppress launching and/or propagation of the TE31 mode. Accordingly, an extremely long taper is needed from the square waveguide 242 to a desired circular waveguide 244. In addition, the waveguide feed network 200 requires that waveguides be hopped over one another, again greatly increasing complexity and resulting in the loss of a possible split plane.

Figure 5:
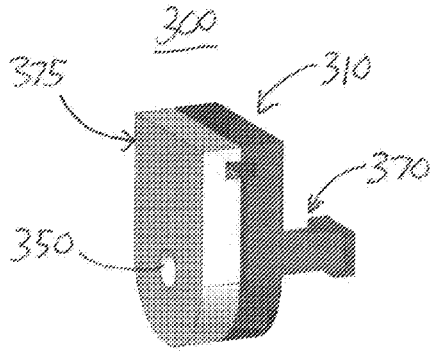
FIG. 5 is a perspective view of the clone carousel dual band waveguide feed network schematically illustrated in FIG. 4, according to certain aspects of the disclosure.

The example clone carousel dual band waveguide feed network (clone carousel feed network) 300 shown in FIGS. 4-8 overcomes the above-discussed limitations and deficiencies, according to certain aspects of the disclosure. The clone carousel feed network 300 includes a TX junction 310 configured as a circular waveguide 320 having multiple RX reject clone filters 330 and multiple main RX reject full filters 340 spaced symmetrically about an aperture port 350, which may be enclosed in a housing 375 as shown in FIG. 5. For example, the clone carousel feed network 300 shown in FIGS. 4-8 has six RX reject clone filters 330 and two main RX reject full filters 340, all spaced symmetrically in 45 degree increments within the same plane around the aperture port 350. Utilizing six RX reject clone filters 330 provides for suppression of all modes up to TE31 and provides for such suppression in a circular waveguide rather than a square waveguide.

Each RX reject clone filter 330 has one or more stubs, such as three stubs 332, 334, 336, with all six RX reject clone filters 330 configured in the same manner. For example, stub 332 closest to the aperture port 350 may be the shortest stub, while the next stub 334 may be the longest, followed by a medium length stub 336. The two main RX reject full filters 340 have a first portion 348 with stubs 342, 344, 346 configured to mirror the stubs 332, 334, 336 of the RX reject clone filters 330, and a second portion 349 with additional stubs 343, 345, 347, where the second portion 349 is disposed further away from the aperture port 350 than the first portion 348. Accordingly, the mirrored stub patterns of the six RX reject clone filters 330 and the two first portions 348 of the main RX reject full filters 340 provide outstanding symmetry from the TX junction 310.

As shown the stubs 332, 334, 336 and 342-347 are protruding outward. In some embodiments, the RX reject clone filters 330 and/or the main RX reject full filters 340 are implemented to prevent signals in certain frequency bands to reach input ports of the TX junction 310. In some examples, the RX reject clone filters 330 and/or the main RX reject full filters 340 are low pass filters and the sizes of the RX reject clone filters 330 and/or the main RX reject full filters 340, including the sizes of stubs 332, 334, 336 and/or 342-347, as well as a number of the stubs may be determined based on an allowed wavelength and a rejection band of the RX reject clone filters 330 and/or the main RX reject full filters 340. In some examples, the RX reject clone filters 330 and/or the main RX reject full filters 340 suppress a signal in a predetermined range that is received via the circular waveguide 320 (e.g., core waveguide) from reaching input ports of the TX junction 310.

A free end of stubs 332, 334, 336 and 342-347 may be short-circuited. Additional stubs may be integrated into the RX reject clone filters 330 and/or the main RX reject full filters 340 to further shape a frequency response of the RX reject clone filters 330 and/or the main RX reject full filters 340.

The two main RX reject full filters 340 are coupled to a branch line coupler (also referred to as a "hybrid coupler" and/or an "E-plane coupler") 360. The branch line coupler 360 has a TX RHCP signal port 362 and a TX LHCP signal port 364 (e.g., input ports). The clone carousel feed network 300 may also include an RX polarizer (e.g., RX septum polarizer) 370, which is coupled (e.g., mated) to a rear end 352 of the circular waveguide 320 and/or aperture port 350. The RX polarizer 370 includes an RX RHCP signal port 372 and an RX LHCP signal port 374. The RX polarizer 370 may be formed or fabricated as a single block. Instead of an RX septum polarizer, the RX polarizer 370 may be a receiver unit having an integrated branch line coupler coupled between the two branches for creating linearly polarized signals from the left hand and right hand circularly polarized signals (not shown).

In some aspects, a linearly polarized input signal is received through one of TX RHCP signal port 362 and a TX LHCP signal port 364 and a circularly polarized signal is generated in the circular waveguide 320 and/or aperture port 350. In some aspects, the circular waveguide 320 and/or aperture port 350 may have a larger perimeter or diameter at a front end 354 than at the rear end 352. For example, a smaller diameter of the circular waveguide 320 and/or aperture port 350 at the rear end 352 (e.g., receiver end) may provide a higher cut off frequency for the RX polarizer 370 than for the TX junction 310.

The TX junction 310, branch line coupler 360 and RX polarizer 370 are combined as the clone carousel feed network 300 to form a three-part assembly. For example, the TX junction 310, branch line coupler 360 and RX polarizer 370 may be separately formed components, or any of the TX junction 310, branch line coupler 360 and RX polarizer 370 may be integrally formed with any other of the TX junction 310, branch line coupler 360 and RX polarizer 370. In one or more aspects, the clone carousel feed network 300 may be formed as a single integral component, such as by 3D printing, for example.

The TX junction 310 with six RX reject clone filters 330 and two main RX reject full filters 340 coupled to the branch line coupler 360 provides outstanding higher order mode suppression (e.g., TM01, TE21, TE01, TM11, TE31) inRX. Modes can be launched due to manufacturing asymmetry, so the symmetrically disposed presence of the RX reject clone filters 330 prevents the higher order modes from launching at all or from significantly launching. This is very beneficial because once a higher order mode is launched it does not tend to decay and is free to propagate, causing distortion or signal disruption. The higher order modes up through TM11 may be suppressed with only two RX reject clone filters 330, while all six RX reject clone filters 330 may be used to suppress TE31 mode. Also, the clone carousel feed network 300 is configured to allow the dominant lower order mode (e.g., TE11), which may be the communication channel, to decay to cutoff. Additionally, the clone carousel feed network 300 is configured to permit an asymmetrical drive for TX generation of circular polarization. For example, the TX junction 310 may be driven asymmetrically by a hybrid branch line coupler 360 that is coupled to the main RX reject full filters 340.

A beneficial attribute of the clone carousel feed network 300 is that no hopping of the waveguide is required, so the TX junction 310 is composed of a single split plane on the zero current region of the waveguides. Yet another beneficial attribute of the clone carousel feed network 300 is that it does not require perfection or tuning (e.g., squeeze tuning of reactive recombination arms) because there are no recombination paths.

FIG. 9 is a table 900 illustrating a performance summary of an example 20/45 GHz clone carousel feed network using Mician modeling, according to certain aspects of the disclosure. Table 900 shows that all simulation values for TX/RX band, TX/RX insertion loss, TX/RX return loss, TX/RX axial ration, TE10 isolation in TX/RX band, TE20 suppression in RX band, RX higher order mode (HOM) suppression, RX TM11 suppression, and TX/RX RHCP to LHCP isolation are at or better than the specification limits. The TE10 isolation in RX band value is driven by the TE20 mode. TM11 mode is optimized into a potter horn, yielding about 33 dB on TM11.

FIGS. 10A, 10B, 10C, 10D and 10E are charts 1000A1, 1000A2, 1000B1, 1000B2, 1000C1, 1000C2, 1000D1, 1000D2, 1000E1, 1000E2 illustrating TX and RX return-loss performance, TX/RX isolation performance, and TX and RX axial-ratio performance of an example clone carousel feed network, according to certain aspects of the disclosure.

Chart 1000A1 shows plot 1010 of the variation of TX return loss at the described TX signal ports of the clone carousel feed network 300. These return-loss values, as depicted by plot 1010, are lower than -22 dB and well below a specification limit of about -20 dB, as shown by a line 1011. Chart 1000A2 shows plot 1015 of the variation of the RHCP to LHCP isolation between a RHCP TX signal port and a LHCP TX signal port of the clone carousel feed network 300 (e.g., between TX RHCP signal port 362 and TX LHCP signal port 364). This return-loss value, as depicted by plot 1015, is lower than -26 dB and well below a specification limit of about -23 dB, as shown by a line 1016.

Chart 1000B1 shows plot 1020 of the variation of RX return loss at the described RX signal ports of the clone carousel feed network 300. These return-loss values, as depicted by plot 1020, are lower than -43 dB and well below a specification limit of about -18 dB, as shown by a line 1021. Chart 1000B2 shows plot 1025 of the variation of the RHCP to LHCP isolation between a RHCP RX signal port and a LHCP RX signal port of the clone carousel feed network 300 (e.g., between RX RHCP signal port 372 and RX LHCP signal port 374). This return-loss value, as depicted by plot 1025, is lower than -26 dB and well below a specification limit of about -23 dB, as shown by a line 1026.

Chart 1000C1 shows plot 1030 of the variation of TX-to-RX port isolation between the above described TX signal ports and RX signal ports of the clone carousel feed network 300. The TX-to-RX port isolation values, as depicted by plot 1030, are lower than about -150 dB and well below a specification limit of about -55 dB, as shown by a line 1031. Chart 1000C2 shows plots 1040-1046, some of which are overlapping plots, of TX higher order mode suppression. Plots 1040-1046 represent higher order modes TM01, TE21, TE01, TM11 and TE31. As shown by plots 1040-1046, the higher order content is less than -65 dB for the clone carousel feed network 300. This is below a specification limit of about -40 dB, as shown by the line 1038, and does not degrade axial-ratio performance or antenna patterns of the clone carousel feed network 300.

Chart 1000D1 shows plot 1050 of the variation of TE10 TX/RX isolation (in RX band) between the above described TX signal ports and RX signal ports of the clone carousel feed network 300. The TE10 TX/RX isolation (in RX band) values, as depicted by plot 1050, are lower than about -150 dB and well below a specification limit of about -65 dB, as shown by a line 1051. Chart 1000D2 shows plots 1055 and 1056 of TE20 suppression (in RX band). The TE20 suppression (in RX band) values, as depicted by plots 1055 and 1056, are lower than about -80 dB and well below a specification limit of about -65 dB, as shown by a line 1058.

Charts 1000E1 and 1000E2 show plots 1050, 1055 of the variation of TX and RX axial ratios at the above described TX and RX signal ports of the clone carousel feed network 300. The TX axial ratio values, as depicted by plot 1050, are lower than about 0.40 dB and well below a specification limit of about 0.5 dB, as shown by a line 1051. The RX axial ratio values, as depicted by plot 1055, are lower than about 0.10 dB and well below a specification limit of about 0.25 dB, as shown by a line 1056.

Figure 11A:
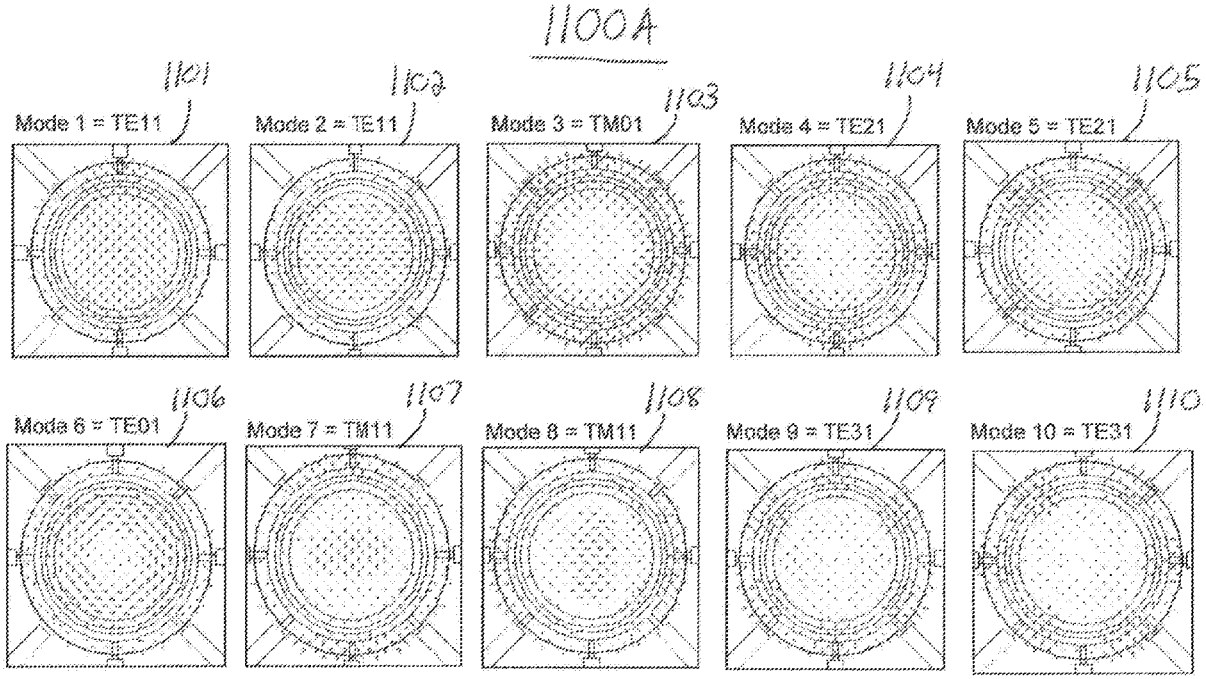
FIGS. 11A, 11B and 11C are charts illustrating aperture pipe modes, RX higher order mode suppression and insertion loss performance of an example clone carousel feed network, according to certain aspects of the disclosure.
Figure 11B:
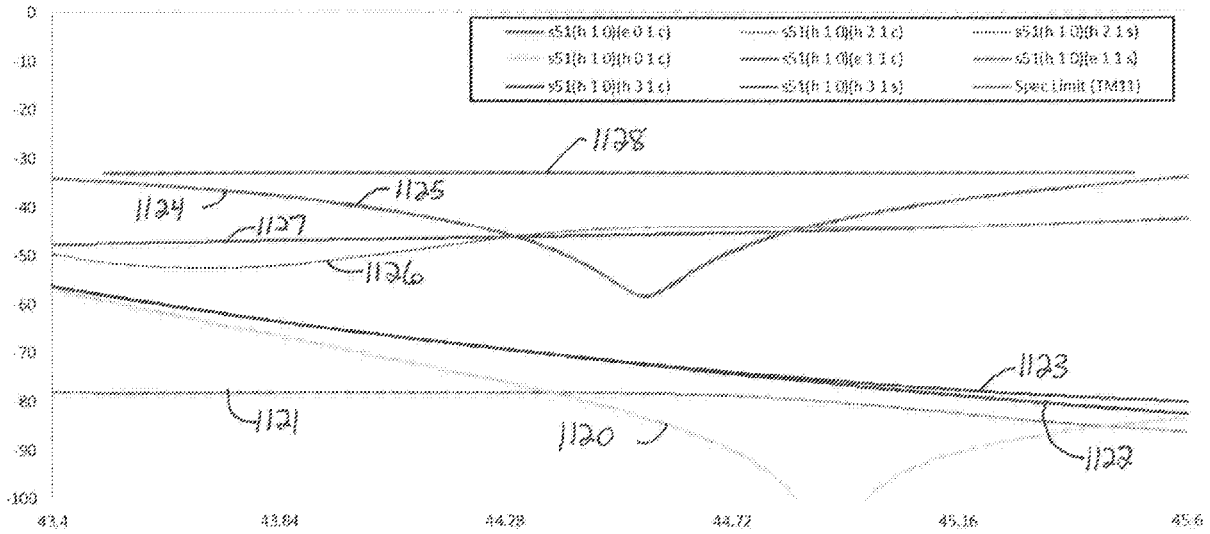
Figure 11D:
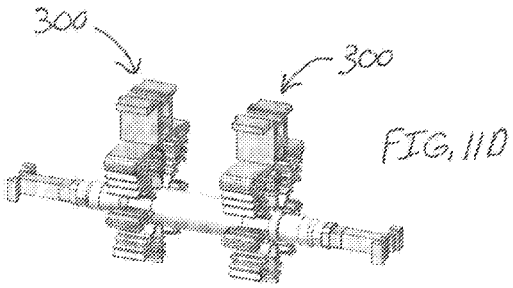
Figure 11C:
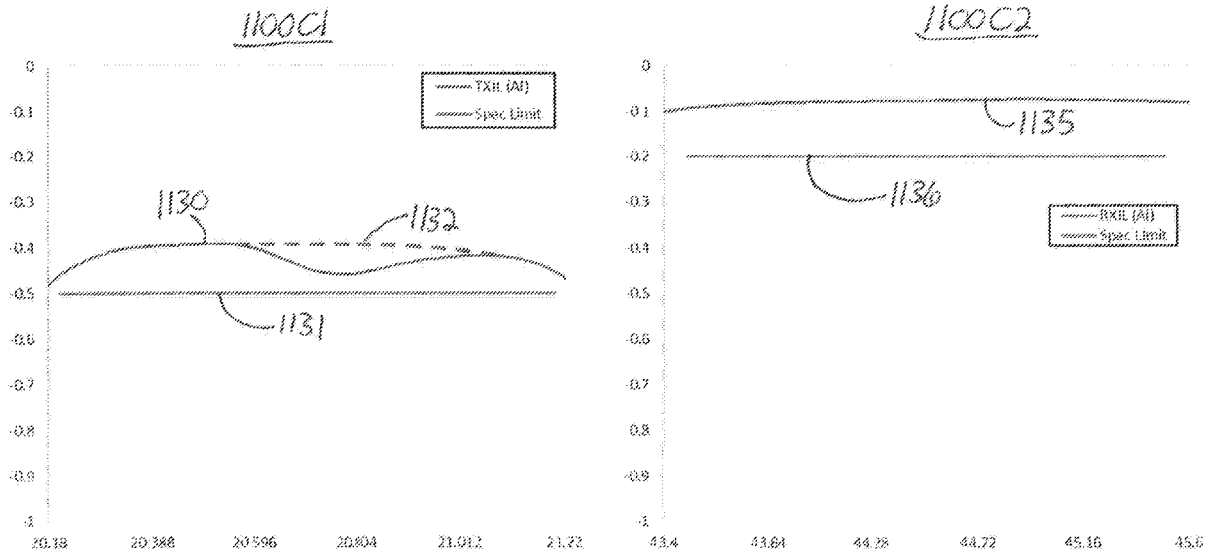

FIGS. 11A, 11B and 11C are charts 1100A, 1100B, 1100C1 and 1100C2 illustrating modes on an aperture pipe (e.g., aperture 350) at 45 GHz, RX higher order mode suppression (minus TM11), and TX/RX insertion loss (aluminum) in the clone carousel feed network 300, according to certain aspects of the disclosure..

Chart 1100A shows suppression patterns 1101-1110 for modes 1-10, where 1101 (mode 1) and 1101 (mode 2) are associated with TE11, 1103 (mode 3) is associated with TM01, 1104 (mode 4) and 1105 (mode 5) are associated with TE21, 1106 (mode 6) is associated with TE01, 1107 (mode 7) and 1108 (mode 8) are associated with TM11, and 1109 (mode 9) and 1110 (mode 10) are associated with TE31. As shown by the suppression patterns, modes 3-10 are higher order modes that are suppressed by the clone filters discussed above (e.g., RX reject clone filters 330).

Chart 1100B shows plots 1120-1127, some of which are overlapping plots, of RX higher order mode suppression. Plots 1120-1127 represent higher order modes TM01, TE21, TE01 and TE31. As shown by plots 1120-1127, the higher order content is less than -43 dB for the clone carousel feed network 300. This is below the separate suppression of mode TM11 of about -35 dB, which is set as a specification limit, as shown by the line 1128, and does not degrade axial-ratio performance or antenna patterns of the clone carousel feed network 300.

Charts 1100C1 and 1100C2 show plots 1130, 1135 of the variation of TX and RX insertion loss (based on aluminum material) at the above described TX and RX signal ports of the clone carousel feed network 300. The TX insertion loss values, as depicted by plot 1130, are higher than about -0.45 dB and well above a specification limit of about -0.5 dB, as shown by a line 1131. The line 1132 depicts VSWR stack up due to the back to back configuration. The RX insertion loss values, as depicted by plot 1135, are higher than about -0.10 dB and well above a specification limit of about -0.20 dB, as shown by a line 1136. The results are based on back-to-back clone carousel feed networks 300 as shown in FIG. 1100D, which were then divided by two to yield the line 1131 and the plots 1130, 1135 and 1136.

Figure 12A:
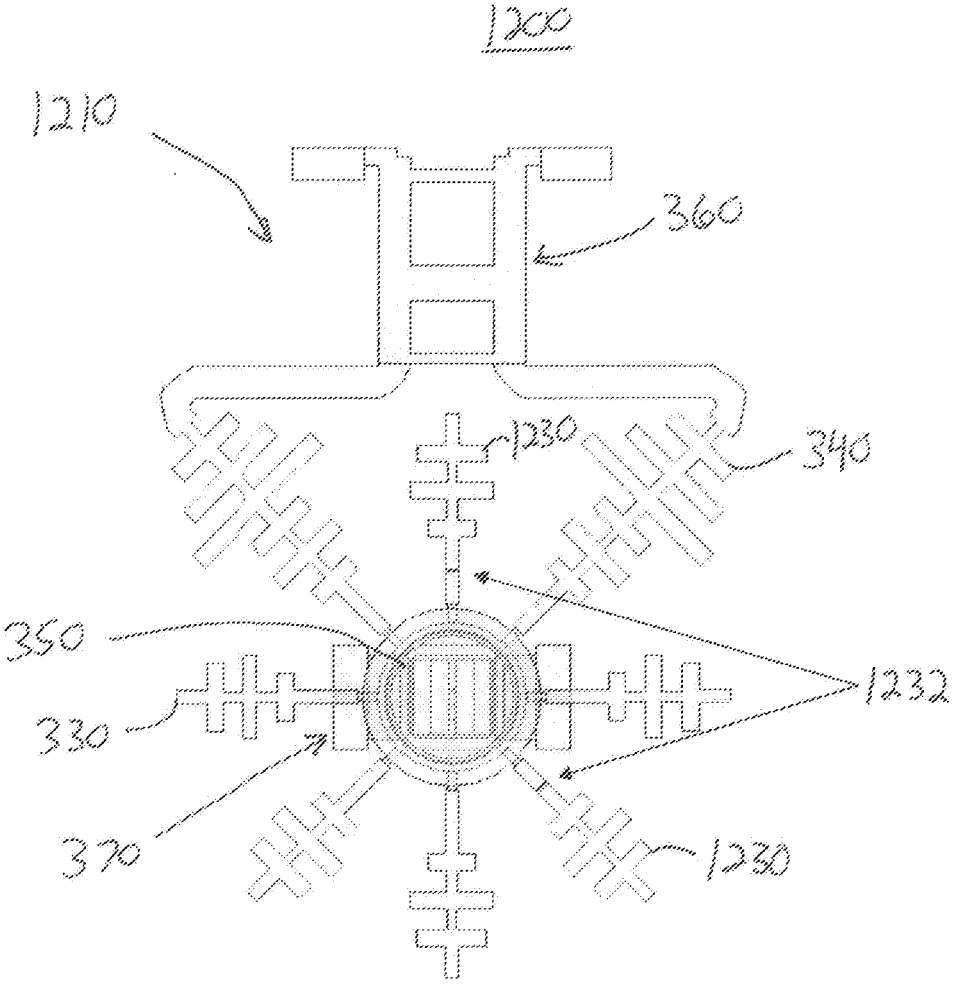
FIGS. 12A and 12B are a front view of an example asymmetric clone carousel feed network and charts illustrating RX higher order mode suppression of the example asymmetric clone carousel feed network, according to certain aspects of the disclosure.
Figure 12B:
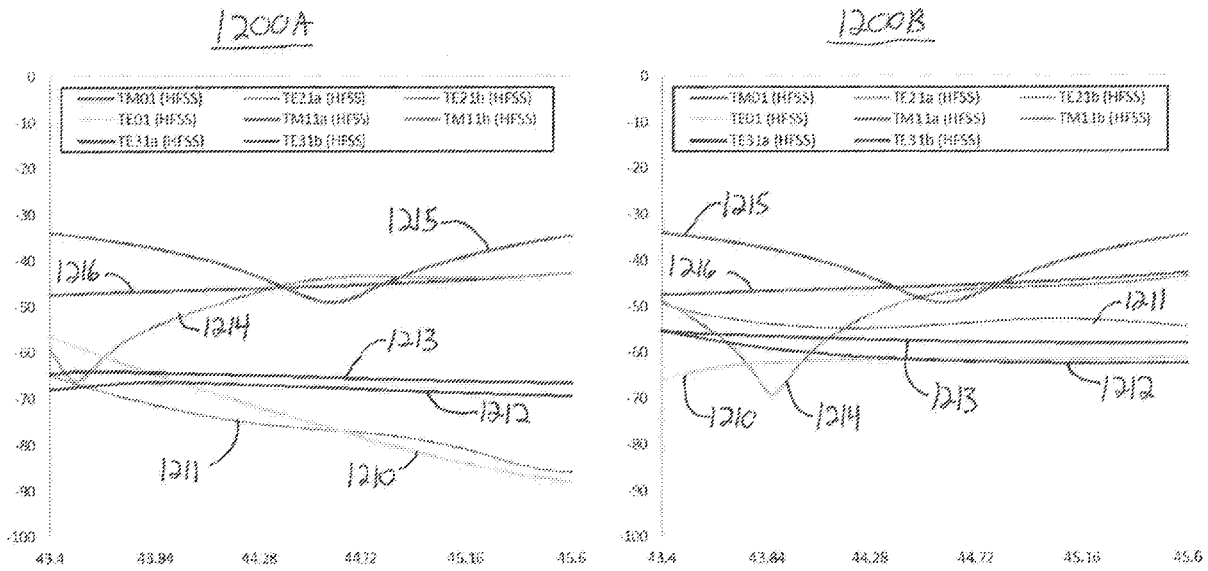

FIGS. 12A and 12B are a schematic front view of an example asymmetric clone carousel feed network 1200 and charts 1200A and 1200B illustrating RX higher order mode suppression of the asymmetric clone carousel feed network 1200, according to certain aspects of the disclosure.

Asymmetric clone carousel feed network 1200 is substantially similar to symmetric clone carousel feed network 300, with a TX junction 1210 having four RX reject clone filters 330, two main RX reject full filters 340 and an aperture 350, a branch line coupler 360, and an RX polarizer 370. The asymmetry difference is introduced by the other two RX reject clone filters 1230, which are two RX reject clone filters 330 shifted (e.g., made longer) by 0.002 inch, as shown by portion 1232. This slight shift introduces an asymmetric condition on the threshold of reasonable manufacturing tolerances. For example, a plus/minus 0.001 inch tolerance may be readily achieved, so a plus/minus shift of 0.002 inch may simulate a worst case manufacturing scenario.

Charts 1200A and 1200B show plots 1210-1216 for nominal and asymmetric results of RX higher order mode suppression. Plots 1210-1216 represent higher order modes TM01, TE21, TE01, TM11 and TE31. As shown by plots 1210-1216, the higher order content remains less than -43 dB for both the nominal results (e.g., using clone carousel feed network 300) and the asymmetric results (e.g., using clone carousel feed network 1200). In the asymmetric results shown in chart 1200B, most of the modes (e.g., TE01, TE21, TE31) rise under the asymmetric conditions introduced by the shifted RX reject clone filters 1230, while the plot 1216 representing mode TM11 remains unchanged. Thus, all of the higher order modes stay non-spurious and remain under a specification limit (e.g., about -35 dB). Accordingly, the asymmetry introduced by the shifted RX reject clone filters 1230 does not degrade axial-ratio performance or antenna patterns of the clone carousel feed network 1200.

Figure 13A:
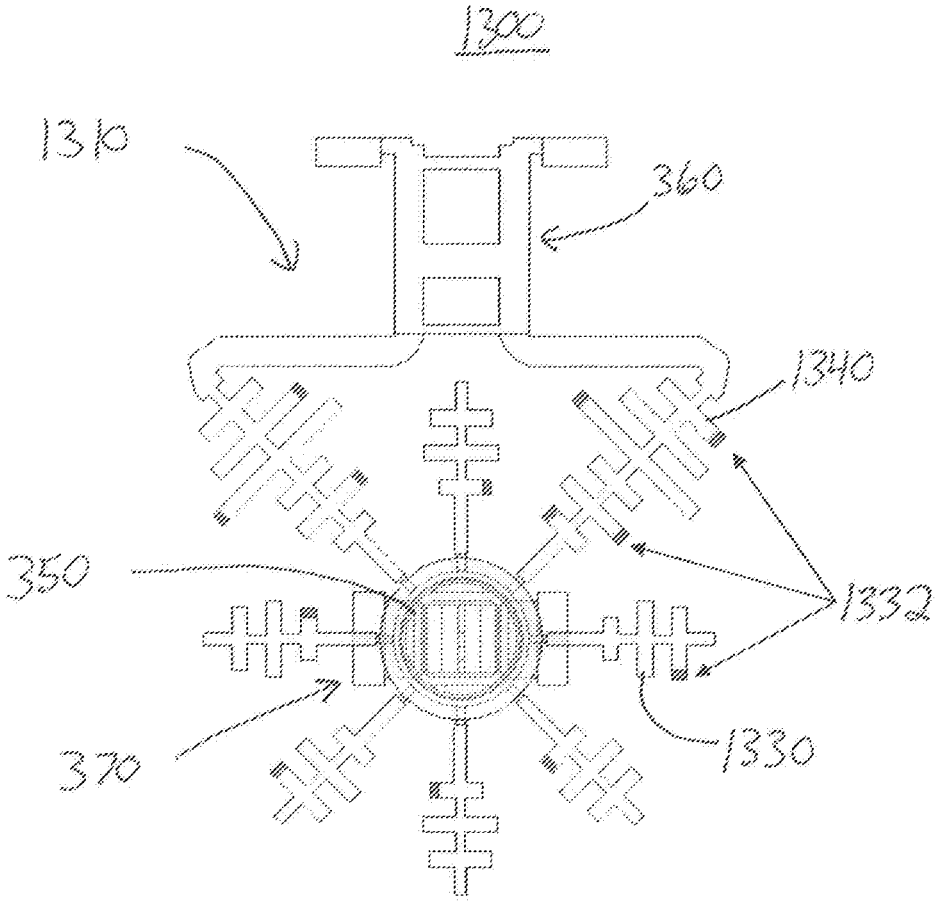
FIGS. 13A and 13B are a front view of another example asymmetric clone carousel feed network and charts illustrating RX higher order mode suppression of the example asymmetric clone carousel feed network, according to certain aspects of the disclosure
Figure 13B:
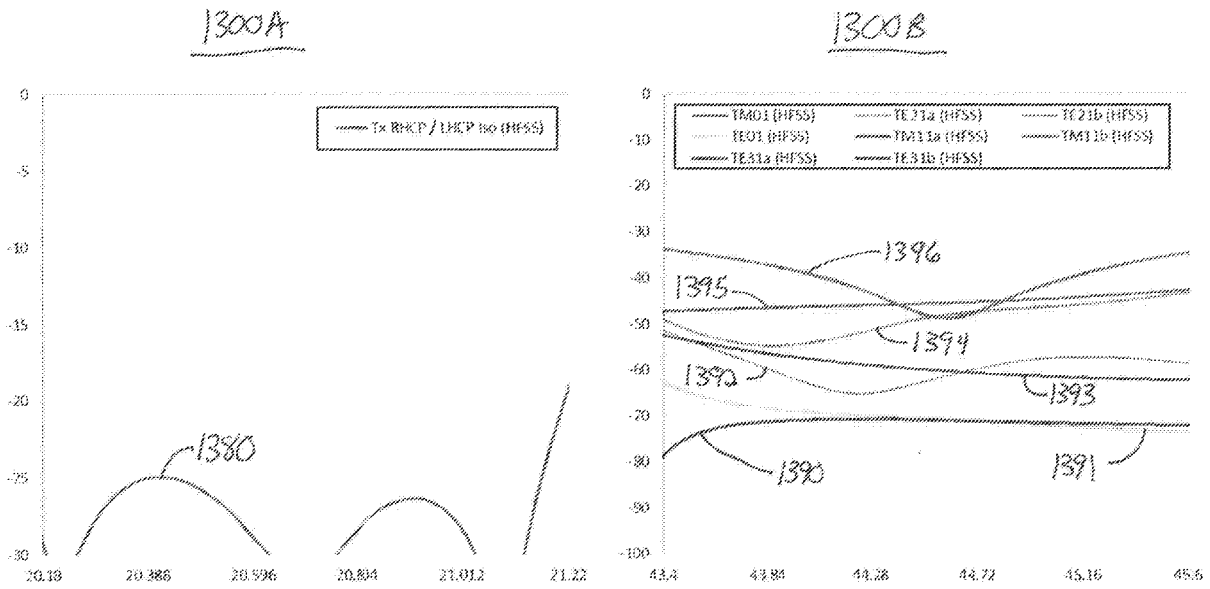

FIGS. 13A and 13B are a schematic front view of an example asymmetric clone carousel feed network 1300 and charts 1300A and 1300B illustrating TX RHCP/LHCP isolation and RX higher order mode suppression of the asymmetric clone carousel feed network 1300, according to certain aspects of the disclosure.

Asymmetric clone carousel feed network 1300 is similar to symmetric clone carousel feed network 300 in that it has an aperture 350, a branch line coupler 360, and an RX polarizer 370. Here, TX junction 1310 has six RX reject clone filters 1330 and two main RX reject full filters 1340, which are six RX reject clone filters 330 and two main RX reject full filters 340 for which cavities 1332 have been randomly grown (e.g., made longer) on some of the stubs. The results shown in charts 1300A and 1300B are based on a cavity 1332 growth of 0.002 inch. This slight shift introduces an asymmetric condition on the threshold of reasonable manufacturing tolerances. For example, a plus/minus 0.001 inch tolerance may be readily achieved, so a plus/minus shift of 0.002 inch may simulate a worst case manufacturing scenario.

Chart 1300A shows plot 1380 for TX RHCP/LHCP isolation values based on a 0.002 inch growth from the cavities 1332. Plot 1380 shifts down in frequency from a typical symmetric clone carousel feed network 300 result.

Chart 1300B show plots 1390-1396 for asymmetric results of RX higher order mode suppression. Plots 1390-1396 represent higher order modes TM01, TE21, TE01, TM11 and TE31. As shown by plots 1390-1396, the higher order content remains less than -43 dB for the asymmetric results (e.g., using clone carousel feed network 1300). Similar to the asymmetric results shown in chart 1200B, all of the higher order modes stay non-spurious and remain within a specification limit (e.g., about -35 dB). Accordingly, the asymmetry introduced by the RX reject clone filters 1330 and two main RX reject full filters 1340 does not degrade axial-ratio performance or antenna patterns of the clone carousel feed network 1300.

Clone carousel feed network 300 may be connected to well-matched Hbends (not shown) that may be coupled to the branch line coupler 360 and transformers (not shown) may be coupled to the Hbends to provide compliance to desired interfaces.

The disclosed clone carousel feed network (e.g., clone carousel feed network 300, 1200, 1300) provides for an increased separation between TX and RX over the separation of a typical dual band TX and RX waveguide feed network (e.g., dual band TX and RX waveguide feed 200). Thus, more modes may exist on the TX manifold (e.g., TX junction 310) that feeds the aperture (e.g., aperture 350). The disclosed clone carousel feed network supports both instances of the TE11 dominant mode and suppresses all other higher order modes TMO1, TE01, TE21, TM11 and TE31. Accordingly, the disclosed clone carousel feed network prevents disruption of antenna patterns and of antenna efficiency.

Figure 14:
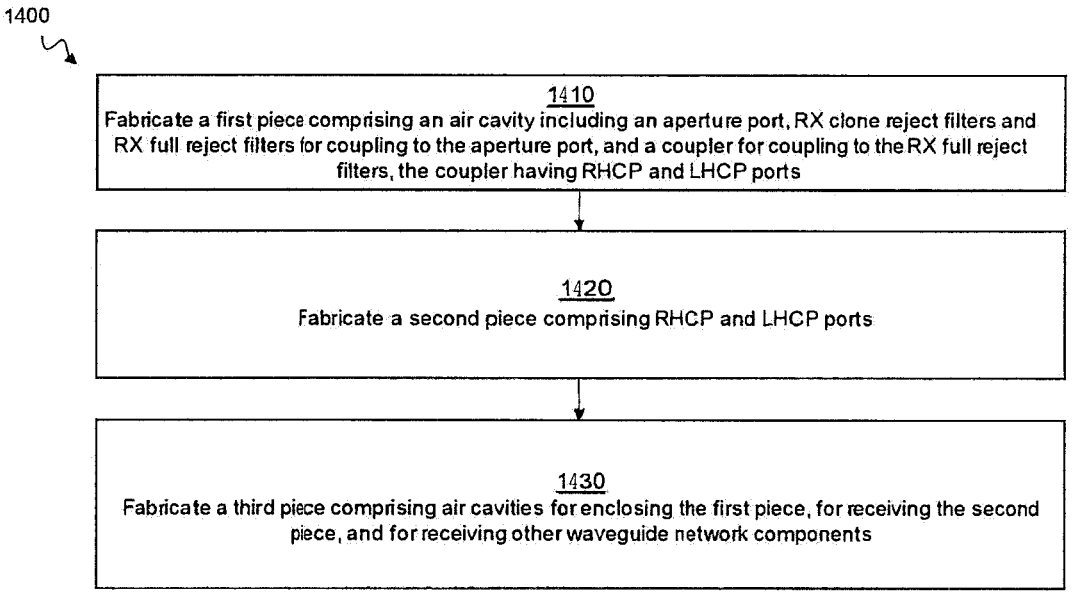
FIG. 14 illustrates a flow diagram of an example process for manufacturing a clone carousel dual band waveguide feed network, according to certain aspects of the disclosure.

FIG. 14 illustrates a flow diagram of an example process 1400 for manufacturing a clone carousel feed network, according to certain aspects of the disclosure. For explanatory purposes, the process 1400 is primarily described herein with reference to the clone carousel feed network 300 and various components described herein with reference to FIGS. 4-8.

Figure 4:
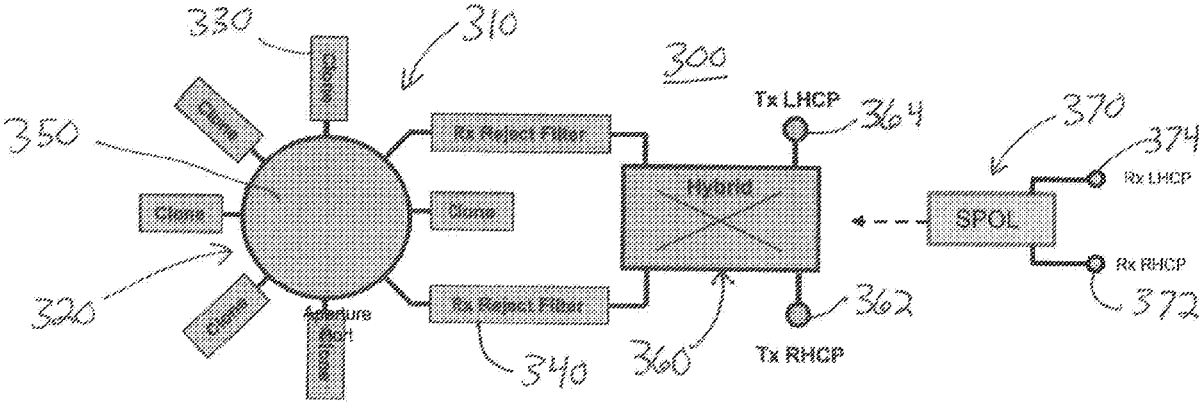
FIG. 4 is a schematic diagram illustrating an example clone carousel dual band waveguide feed network, according to certain aspects of the disclosure.
Figure 6:
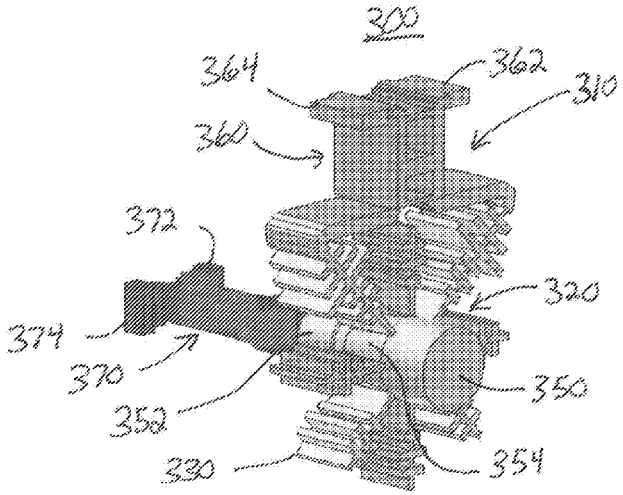
FIG. 6 is a perspective view of the clone carousel dual band waveguide feed network of FIG. 5 without a housing, according to certain aspects of the disclosure.
Figure 7:
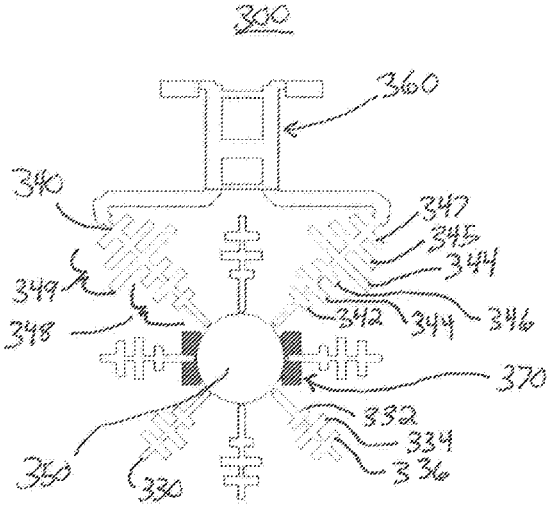
FIG. 7 is a front view of the clone carousel dual band waveguide feed network of FIG. 6, according to certain aspects of the disclosure.
Figure 8:
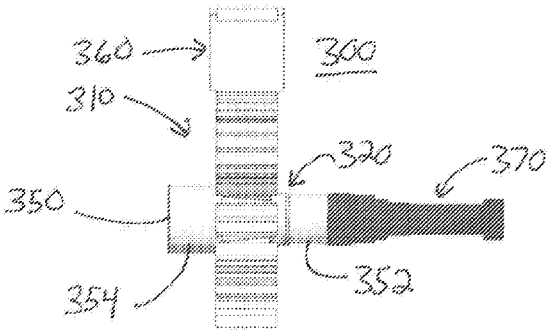
FIG. 8 is a side view of the clone carousel dual band waveguide feed network of FIG. 6, according to certain aspects of the disclosure.
Figure 10A:
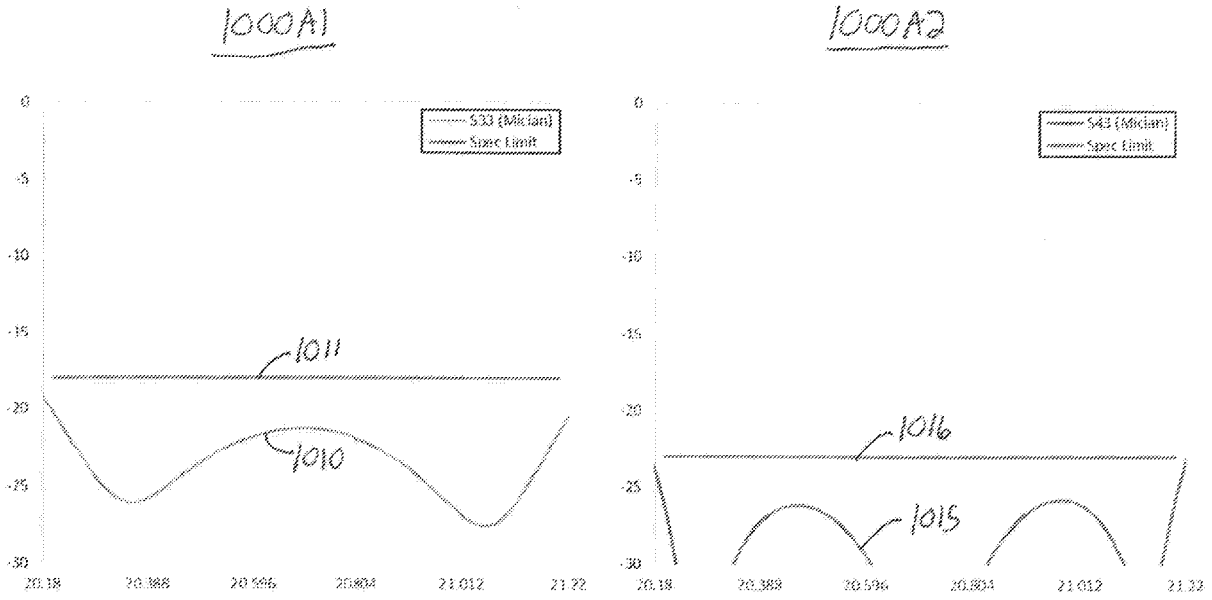
FIGS. 10A, 10B, 10C, 10D and 10E are charts illustrating TX and RX return-loss performance, TX/RX isolation performance, and TX and RX axial-ratio performance of an example clone carousel feed network, according to certain aspects of the disclosure.
Figure 10B:
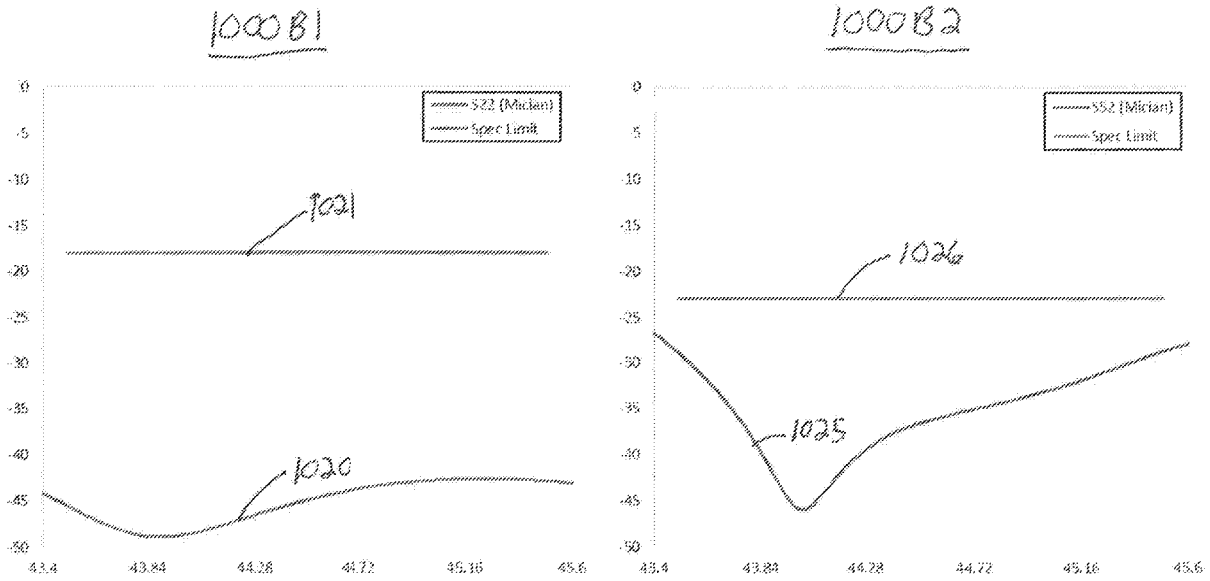
Figure 10C:
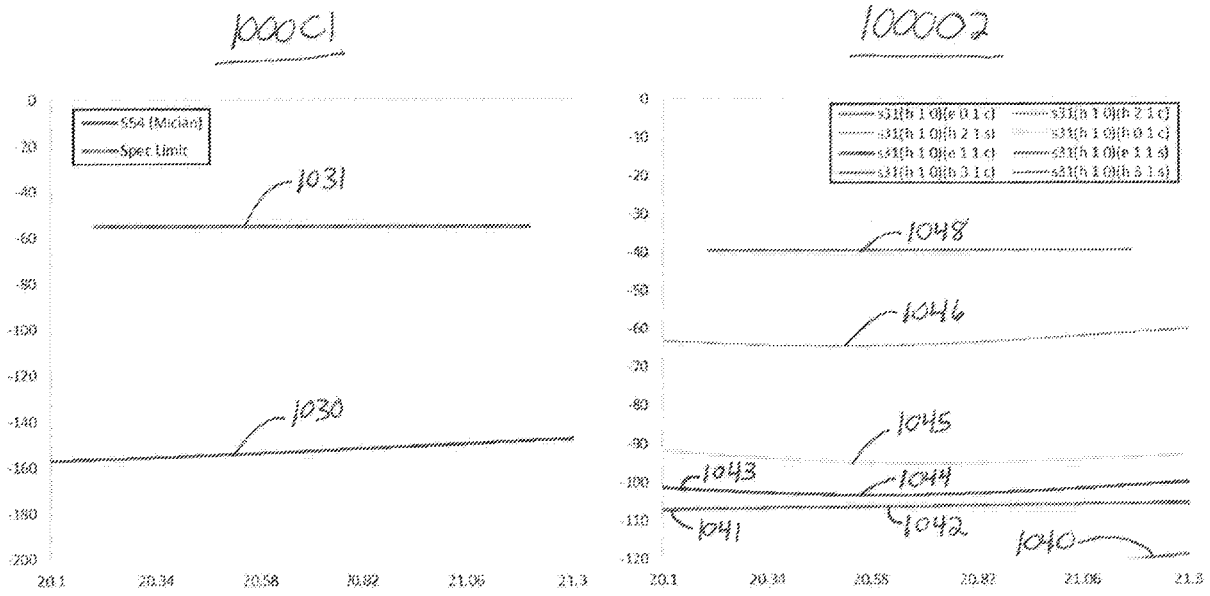
Figure 10D:
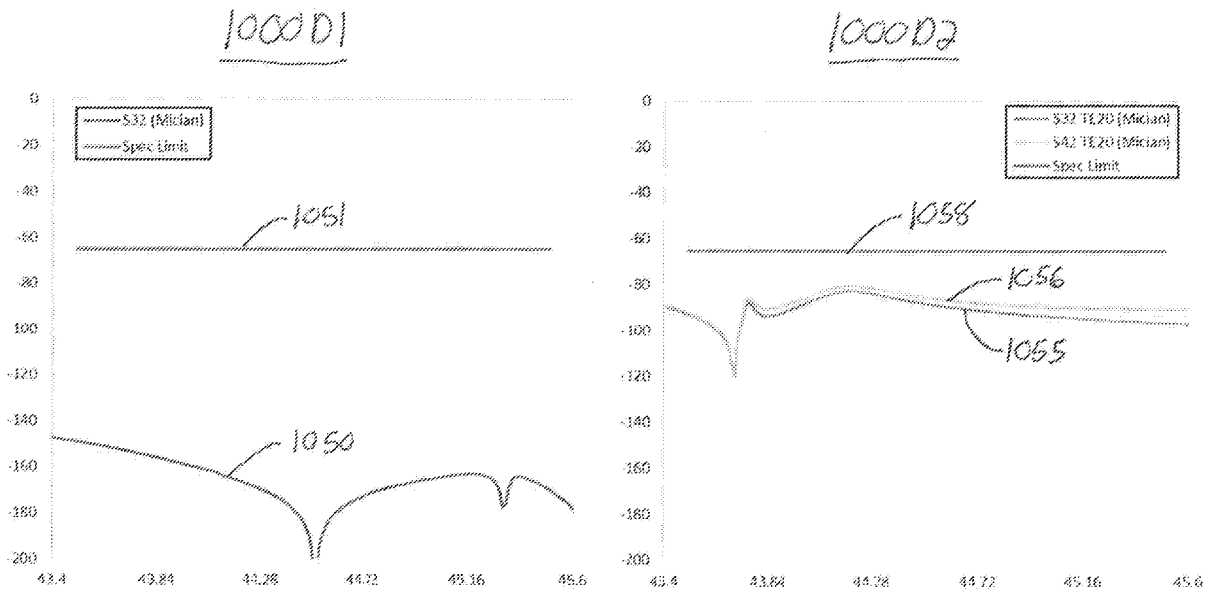
Figure 10E:
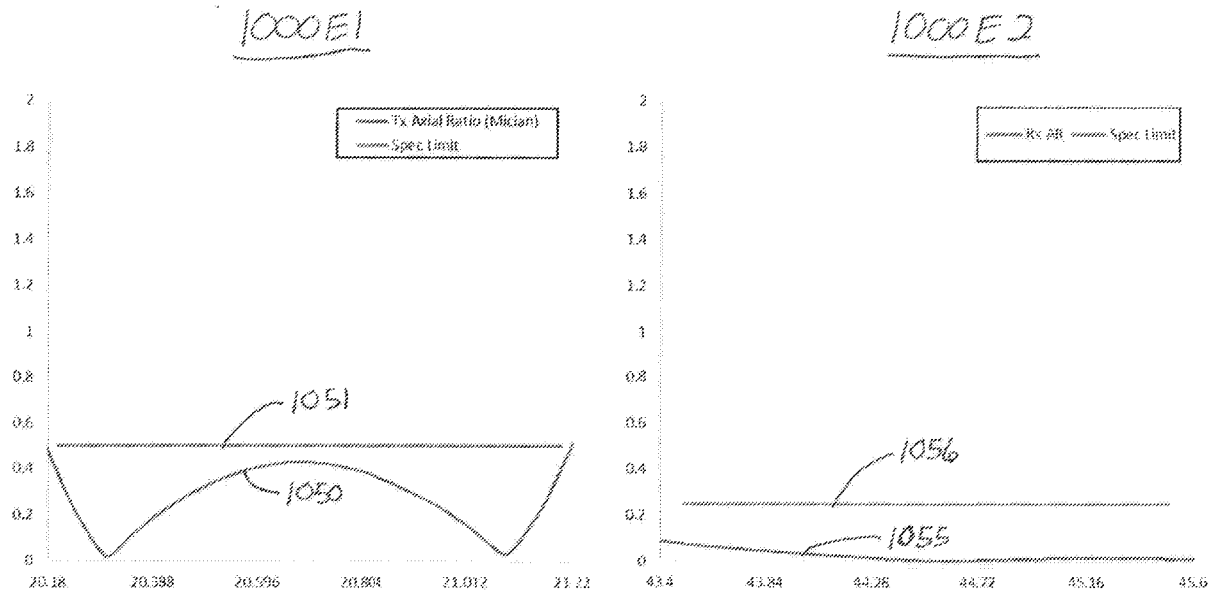

The process 1400 includes fabricating a first piece (e.g., TX junction 310 of FIGS. 4-8) comprising an air cavity including an aperture port (e.g., aperture port 350 of FIGS. 4-8), RX reject clone filters (e.g., RX reject clone filters 330 of FIGS. 4-8) for coupling to the aperture port, RX reject full filters (e.g., RX reject full filters 340 of FIGS. 4-8) for coupling to the aperture port, and a coupler (e.g., hybrid coupler 360 of FIGS. 4-8) for coupling to the RX reject full filters, the coupler having RHCP and LHCP ports (e.g., TX RHCP signal port 362 and TX LHCP signal port 364 of FIGS. 4 and 6) (1410).

The method further includes fabricating a second piece (e.g., RX polarizer 370 of FIGS. 4-8) comprising RHCP and LHCP ports (e.g., RX RHCP signal port 372 and RX LHCP signal port 374 of FIGS. 4 and 6) (1420).

The method further includes fabricating a third piece (e.g. housing 375 of FIG. 5) comprising air cavities for enclosing the first piece, for receiving the second piece, and for receiving other waveguide network components (e.g., Hbends) (1430).

In some aspects, the subject technology is related to antenna technology, and more particularly to a super broadband dual polarization TX, dual polarization RX, circular polarization waveguide network. In some aspects, the subject technology may be used in various markets, including, for example and without limitation, sensor technology, communication systems and radar technology markets.

Those of skill in the art would appreciate that the various illustrative blocks, modules, elements, components, methods, and algorithms described herein may be implemented as electronic hardware, computer software, or combinations of both. To illustrate this interchangeability of hardware and software, various illustrative blocks, modules, elements, components, methods, and algorithms have been described above generally in terms of their functionalities. Whether such functionalities are implemented as hardware or software depends upon the particular application and design constraints imposed on the overall system. Skilled artisans may implement the described functionalities in varying ways for each particular application. Various components and blocks may be arranged differently (e.g., arranged in a different order, or partitioned in a different way), all without departing from the scope of the subject technology.

It is understood that any specific order or hierarchy of blocks in the processes disclosed is an illustration of example approaches. Based upon design preferences, it is understood that the specific order or hierarchy of blocks in the processes may be rearranged, or that all illustrated blocks may be performed. Any of the blocks may be performed simultaneously. In one or more implementations, multitasking and parallel processing may be advantageous. Moreover, the separation of various system components in the embodiments described above should not be understood as requiring such separation in all embodiments, and it should be understood that the described program components and systems can generally be integrated together in a single hardware and software product or packaged into multiple hardware and software products.

The description of the subject technology is provided to enable any person skilled in the art to practice the various aspects described herein. While the subject technology has been particularly described with reference to the various figures and aspects, it should be understood that these are for illustration purposes only and should not be taken as limiting the scope of the subject technology.

A reference to an element in the singular is not intended to mean "one and only one" unless specifically stated, but rather "one or more." The term "some" refers to one or more. All structural and functional equivalents to the elements of the various aspects described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Although the invention has been described with reference to the disclosed aspects, one having ordinary skill in the art will readily appreciate that these aspects are only illustrative of the invention. It should be understood that various modifications can be made without departing from the spirit of the invention. The particular aspects disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative aspects disclosed above may be altered, combined, or modified and all such variations are considered within the scope and spirit of the present invention. While compositions and methods are described in terms of "comprising," "containing," or "including" various components or steps, the compositions and methods can also "consist essentially of" or "consist of" the various components and operations. All numbers and ranges disclosed above can vary by some amount. Whenever a numerical range with a lower limit and an upper limit is disclosed, any number and any subrange falling within the broader range are specifically disclosed. Also, the terms in the claims have their plain, ordinary meanings unless otherwise explicitly and clearly defined by the patentee. If there is any conflict in the usage of a word or term in this specification and one or more patent or other documents that may be incorporated herein by reference, the definition that is consistent with this specification should be adopted.

What is claimed is:

1. A super-broadband waveguide feed network comprising:

a transmit (TX) junction comprising:

an aperture port;

two receive (RX) reject full filters coupled to the aperture port and configured to reject RX frequencies; and six RX reject clone filters coupled to the aperture port and configured to reject RX frequencies;

a branch line coupler coupled to the two RX reject full filters; and an RX polarizer coupled to the aperture port, wherein the two RX reject full filters and the six RX reject clone filters are disposed symmetrically around the aperture port, and the super-broadband waveguide feed network is circularly polarized, wherein the two RX reject full filters and the six RX reject clone filters are all spaced in 45 degree increments within the same plane around the aperture port.

2. The super-broadband waveguide feed network of claim 1, wherein each of the six RX reject clone filters conforms to a first structural configuration.

3. The super-broadband waveguide feed network of claim 2, wherein each of the two RX reject full filters has a first portion and a second portion, wherein the first portion conforms to the first structural configuration.

4. The super-broadband waveguide feed network of claim 3, wherein the first structural configuration comprises first, second and third stubs disposed respectively farther from the aperture port.

5. The super-broadband waveguide feed network of claim 4, wherein the third stub has a longer length than the first stub and a shorter length than the second stub.

6. The super-broadband waveguide feed network of claim 4, wherein the second portion of each of the RX reject full filters comprises additional stubs disposed farther from the aperture port than the first, second and third stubs.

7. The super-broadband waveguide feed network of claim 1, wherein the TX junction comprises a single split plane on a TX zero-current waveguide region.

8. The super-broadband waveguide feed network of claim 1, wherein the two RX reject full filters and the six RX reject clone filters provide a symmetric condition, and wherein the TX junction is configured to suppress launch of higher order modes TE01, TM01, TM11, TE21 and TE31.

9. The super-broadband waveguide feed network of claim 1, wherein a trunk length of one of the six RX reject clone filters is longer than a trunk length of another of the six RX reject clone filters, and wherein the TX junction is configured to suppress launching of the higher order modes TE01, TM01, TM11, TE21 and TE31 in a resulting asymmetric condition.

10. The super-broadband waveguide feed network of claim 1, wherein a stub of one of the six RX reject clone filters comprises a grown cavity, and wherein the TX junction is configured to suppress launching of the higher order modes TE01, TM01, TM11, TE21 and TE31 in a resulting asymmetric condition.

11. The super-broadband waveguide feed network of claim 1, wherein a stub of one of the two RX reject full filters comprises a grown cavity, and wherein the TX junction is configured to suppress launching of the higher order modes TE01, TM01, TM11, TE21 and TE31 in a resulting asymmetric condition.

12. The super-broadband waveguide feed network of claim 1, wherein the super-broadband waveguide feed network is configured to operate at a TX to RX band ratio of 20/45.

13. The super-broadband waveguide feed network of claim 12, wherein TX is 20 GHz and RX is 45 GHz.

14. The super-broadband waveguide feed network of claim 1, wherein the TX junction, the RX polarizer and the branch line coupler are fabricated using at least one of machining, electroplating and three-dimensional (3D) printing.

15. The super-broadband waveguide feed network of claim 1, wherein the RX polarizer is coupled to an end of the aperture port having a smaller diameter than the other end of the aperture port and configured to provide a higher cut off frequency for the RX polarizer than for the TX junction.

16. An antenna array system comprising:

an antenna array comprising a plurality of antenna elements; and a plurality of super-broadband waveguide feed networks, each coupled to an antenna element of the antenna array, each super-broadband waveguide feed network comprising:

a transmit (TX) junction comprising:

an aperture port;

two receive (RX) reject full filters coupled to the aperture port and configured to reject RX frequencies; and six RX reject clone filters coupled to the aperture port and configured to reject RX frequencies;

a branch line coupler coupled to the two RX reject full filters; and an RX polarizer coupled to the aperture port, wherein the two RX reject full filters and the six RX reject clone filters are disposed symmetrically around the aperture port, and the super-broadband waveguide feed network is circularly polarized, wherein for each super-broadband waveguide feed network there are two RX reject full filters and six RX reject clone filters all spaced in 45 degree increments within the same plane around the aperture port, and wherein the TX junction is configured to suppress launch of higher order modes TE01, TM01, TM11, TE21 and TE31.

17. A method of manufacturing a super-broadband waveguide feed network, the method comprising:

fabricating a first piece comprising an air cavity including an aperture port, RX reject clone filters for coupling to the aperture port, RX reject full filters for coupling to the aperture port, and a coupler for coupling to the RX reject full filters, the coupler having RHCP and LHCP ports;

fabricating a second piece comprising an RX polarizer having RHCP and LHCP ports; and fabricating a third piece comprising air cavities for enclosing the first piece, for receiving the second piece, and for receiving waveguide network components, the super-broadband waveguide feed network configured to suppress launching of higher order modes TE01, TM01, TM11, TE21 and TE31.

* * * * *